US011046474B2

(12) United States Patent
Spallek et al.

(10) Patent No.: US 11,046,474 B2
(45) Date of Patent: Jun. 29, 2021

(54) CONTAINER HAVING A HEAD PIECE, WHICH CONTAINER CAN BE OR IS FILLED WITH A MEDIUM

(71) Applicant: KOCHER-PLASTIK MASCHINENBAU GMBH, Sulzbach-Laufen (DE)

(72) Inventors: Michael Spallek, Ingelheim (DE); Johannes Geser, Gerlingen (DE); Karl Koeppel, Rainau (DE); Alexander Hammer, Gaildorf (DE)

(73) Assignee: KOCHER-PLASTICK MASCHINEBAU GMBH, Sulzbach-Laufen (DE)

( * ) Notice: Subject to any disclaimer, the term of this patent is extended or adjusted under 35 U.S.C. 154(b) by 106 days.

(21) Appl. No.: 15/327,073

(22) PCT Filed: Nov. 20, 2014

(86) PCT No.: PCT/EP2014/003096
§ 371 (c)(1),
(2) Date: Jan. 18, 2017

(87) PCT Pub. No.: WO2016/015742
PCT Pub. Date: Feb. 4, 2016

(65) Prior Publication Data

US 2017/0144790 A1 May 25, 2017

(30) Foreign Application Priority Data

Jul. 29, 2014 (WO) ..... PCT/EP2014/002076

(51) Int. Cl.
*B65D 1/02* (2006.01)
*B65D 51/00* (2006.01)
(Continued)

(52) U.S. Cl.
CPC ..... *B65D 1/0238* (2013.01); *B65D 1/0207* (2013.01); *B65D 1/04* (2013.01); *B65D 17/12* (2013.01); *B65D 51/002* (2013.01)

(58) Field of Classification Search
CPC ..... A61J 1/00; A61B 19/00; B65D 1/0238; B65D 1/04; B65D 1/06
(Continued)

(56) References Cited

U.S. PATENT DOCUMENTS 758,869 A * 5/1904 Stover ..... B65D 1/06 215/2
3,387,609 A * 6/1968 Shields ..... A61M 5/286 604/202
(Continued)

FOREIGN PATENT DOCUMENTS

DE 25 04 253 8/1975
DE 195 00 459 7/1996
(Continued)

OTHER PUBLICATIONS

International Search Report (ISR) dated Mar. 11, 2015 in International (PCT) Application No. PCT/EP2014/003096.

*Primary Examiner* — Anthony D Stashick
*Assistant Examiner* — Raven Collins
(74) *Attorney, Agent, or Firm* — Wenderoth, Lind & Ponack, L.L.P.

(57) ABSTRACT

A container has a head piece (7). The container can be or is filled with a medium and is produced of plastic materials using a blow molding, filling, and sealing method. A transition region (13) is between the container (1) and a first type of a head surface (11) arranged on the head piece (7) at an end face, can be penetrated by a piercing or cutting part and extends with a specifiable curvature. A second type of a head surface (41) has a specifiable curvature, which is the same as the curvature of the head surface (39) of the first type, but
(Continued)

preferably is different from it and is present on the head piece (7). The head surfaces transition into each other such that a whole surface is formed, which whole surface spans the free end of the transition region (13) directed away from the container (1). The head piece (7) is an integral component of the container (1).

17 Claims, 24 Drawing Sheets

(51) Int. Cl.
*B65D 17/00* (2006.01)
*B65D 1/04* (2006.01)

(58) Field of Classification Search
USPC ..... 215/6; 222/129; 128/272
See application file for complete search history.

(56) References Cited

U.S. PATENT DOCUMENTS 3,905,368 A * 9/1975 Lewis, Jr. ..... A61J 1/1406 128/DIG. 24
4,574,965 A * 3/1986 Meierhoefer ..... A61J 1/1406 215/247
5,232,109 A * 8/1993 Tirrell ..... B65D 51/002 215/247
5,395,365 A * 3/1995 Weiler ..... A61J 1/1406 128/DIG. 24
5,678,713 A * 10/1997 Derksen ..... A61J 1/1406 215/249
D630,475 S * 1/2011 Lu ..... D7/629
2005/0173021 A1* 8/2005 Muto ..... A61J 1/062 141/330
2006/0138169 A1* 6/2006 Cafferty ..... B65D 1/04 222/129
2009/0223999 A1* 9/2009 Hill ..... B65D 1/04 222/129
2011/0186585 A1* 8/2011 Lu ..... B65D 41/04 220/575
2013/0134161 A1 5/2013 Fogel
2013/0140208 A1 6/2013 Herrmann

FOREIGN PATENT DOCUMENTS

EP 0 621 027 10/1994
EP 0 763 476 3/1997
EP 0 565 103 7/1997
EP 1 457 429 9/2004
EP 2 269 558 1/2011
WO 00/76745 12/2000
WO 2012/010563 1/2012
WO 2012/143921 10/2012

* cited by examiner

CONTAINER HAVING A HEAD PIECE, WHICH CONTAINER CAN BE OR IS FILLED WITH A MEDIUM

FIELD OF THE INVENTION

The invention relates to a container having a head piece. The container can be or is filled with a medium and is produced from plastic materials using a blow molding, filling, and sealing method. A transition region between the container and at least one first type of a head surface, arranged on the head piece at a front end, can be penetrated by a piercing or cutting part and extends with a specifiable curvature.

BACKGROUND OF THE INVENTION

Plastic containers, which are produced with a blow molding, filling, and sealing method (BFS method), such as that described in EP 2 269 558 A1 (for example, also referred to as the Bottelpack® system in technical parlance) are used for staple and luxury foods and also used very effectively in the medicinal sector for packaging of pharmaceuticals, diagnostic products, enteral nutrition and medicinal products, e.g. rinsing solutions and dialysis solutions. A significant advantage of such containers intended for these kinds of applications is that the contents only come into contact with a polymer forming the container material, typically a plastic such as LDPE, HDPE or PP. With one-piece containers produced and filled using this BFS method, the low germ levels/sterility of the contents can be guaranteed over longer periods of time. Containers intended for injections or infusions have a special formation of the head region (hereinafter referred to simply as "head piece") for obtaining access to the container contents. The integral formation of container and head piece allows ensuring the sterility of the filling material, while permitting particularly efficient realization of the production process. Caps with elastomer sealing elements (DIN ISO 15759) are mounted on the head piece by welding or injection molding. Such head pieces, as are known from DIN ISO 15759, for example, have a head surface in the form of a head membrane having a convex curvature, which head membrane can be penetrated by a spike or a cannula when the container is used. Containers with such head pieces have several disadvantages. The use of less sharp spikes is preferred because of the reduced risk of injury to the users. This use creates the risk that the head membrane pushes inwards during the piercing operation resulting in a leakage. Leakages can also occur when the head piece is punctured multiple times, e.g. with a spike for a removal operation or with a cannula for the transfer of a separate drug component into the corresponding container, before the actual administration of the container contents.

SUMMARY OF THE INVENTION

Based on this prior art, the problem addressed by the invention is to provide an improved container intended in particular for a medicinal use, which is characterized by improved functional characteristics and which ensures a particularly safe handling, for example, in the case of parenteral or enteral administration.

According to the invention, this problem is solved by a container having, as a significant special characteristic of the invention, at least one second type of a head surface, which likewise has a specifiable curvature, which matches the curvature of the head surface of the first type, but preferably is different therefrom, on the head piece forming an integral component of the container. The head surfaces transition into each other in such a way that an overall surface is formed, which overall surface spans the free end of the transition region directed away from the container. Because the invention, instead of having one uniform head membrane that spans the end of the head piece with a standard curvature, provides for the formation of different head surfaces, which preferably form different curves at the head piece end, the overall surface can have greater resistance to bending and puncturing, cutting or penetration that can be more easily achieved. The deformation of the head membrane during the opening operation and the risk of leaks is then minimal. This structure permits safe handling even when less sharp spikes, cutters or thick cannulas are used. The design of the different head surfaces and the provision of a penetration surface additionally provides a simple, economical solution for optimally adapting caps to the head surfaces, and has significantly smaller elastomer sealing elements compared with DIN ISO 15759. The sealing elements, according to the invention, essentially abut only the penetration surfaces or parts thereof.

Different types of the head surfaces provided on the head piece can transition into each other directly or via a connection region. The arrangement can advantageously be such that, in the case of two types of head surfaces, both have a convex curvature or the one head surface is convex and the other head surface is, relative thereto, concave. In particularly advantageous exemplary embodiments, another, third type of a head surface is provided, which in turn has a different curvature than the other two head surfaces.

The arrangement can also advantageously be such that head surfaces are formed rotationally symmetrical and extend concentric to a longitudinal axis of the container and/or of the transition region and have surface pieces arranged extending transverse to this longitudinal axis.

A particularly effective increase in resistance to bending of the head membrane can be achieved with exemplary embodiments in which the head surface of the first type forms a connecting bridge that spans the free end of the transition region. The other head surface of a different type connects to the connecting bridge at the edge thereof.

Furthermore, the arrangement can advantageously be such that at least one annularly closed head surface of the second type or of another type is arranged on the head surface of the first type. The region of the head surface of the first type surrounded by the annular surface can be provided as a piercing region/cutting region, which is reinforced by the surrounding annularly closed head surface.

The arrangement can particularly advantageously also be such that at least one of the head surfaces forms a bar-shaped stiffening rib, which is mounted on one adjacent head surface or which connects surface parts arranged next to one another of at least one other head surface to one another.

In particularly advantageous exemplary embodiments, at least one head surface of the first type is formed projecting in the manner of a knuckle relative to an adjacent head surface of another type.

Such exemplary embodiments can be particularly advantageously designed such that the projecting head surface and the corresponding cap form at least one connecting part with distinctive connection characteristics. A corresponding connecting part in the form of an adapter can be removably attached to the connecting part with distinctive connection characteristics for a media removal and/or media feed from or into the container. These adapter systems are state of the art. Such adapters can also, as is disclosed in WO 2012/

143921 A1 or EP 0 565 103 B1, for example, be used for a measured addition of a separate fluid, semi-solid or solid drug component to the container. For the direct transfer of the additional component from a receptacle containing this additional component, such adapters have a spike that is sharp on both sides for establishing a direct connection, by which even solid substances, for instance in powder form, can be introduced into the container. The design of the head piece and of the puncturing surfaces envisaged according to the invention permits application-appropriate spacing of puncture points, e.g. in order to simultaneously apply spikes with wide drip chambers (DIN EN ISO 8536-4) and an infusion device with a dosing container (DIN EN ISO 8536-5).

The container according to the invention, for example, in the form of an infusion bottle, can also have at least two opposite or adjacent filling and/or removal openings. On at least one opening, a head piece with head surfaces of a first type and head surfaces of a second type is provided as an integral component of the container.

The subject matter of the invention also comprises multiple-chamber containers (e.g. WO 0076745 A1), which have more than one adjacent and/or opposite filling or removal openings. On at least one opening, a head piece with head surfaces of a first type and of a second type is provided as an integral component of the container.

The subject matter of the invention also comprises caps with elastomer sealing elements, which essentially abut only on the penetration surfaces of the respective head piece.

Other objects, advantages and salient features of the present invention will become apparent from the following detailed description, which, taken in conjunction with the drawings, discloses preferred embodiments of the present invention.

BRIEF DESCRIPTION OF THE DRAWINGS

Referring to the drawings that form a part of this disclosure.

The invention is explained in detail below with reference to exemplary embodiments depicted in the drawings, in which.

DETAILED DESCRIPTION OF THE INVENTION

Figure 1:
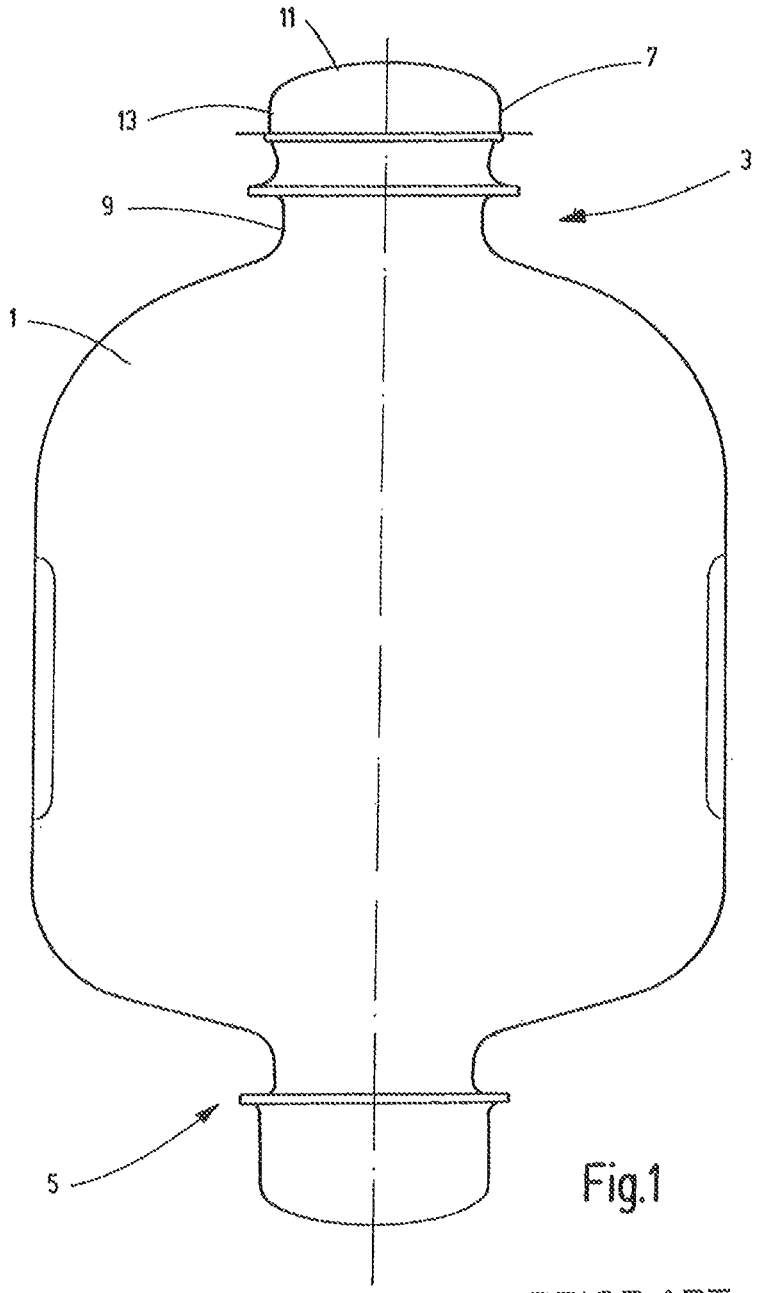
Fig.1 PRIOR ART
FIG. 1 is a front view, slightly enlarged compared with a practical embodiment, of a container in the form of an infusion bottle with two removal openings, the upper one of which in the figure is provided with a head piece according to the prior art of DIN ISO 15759.
Figure 2:
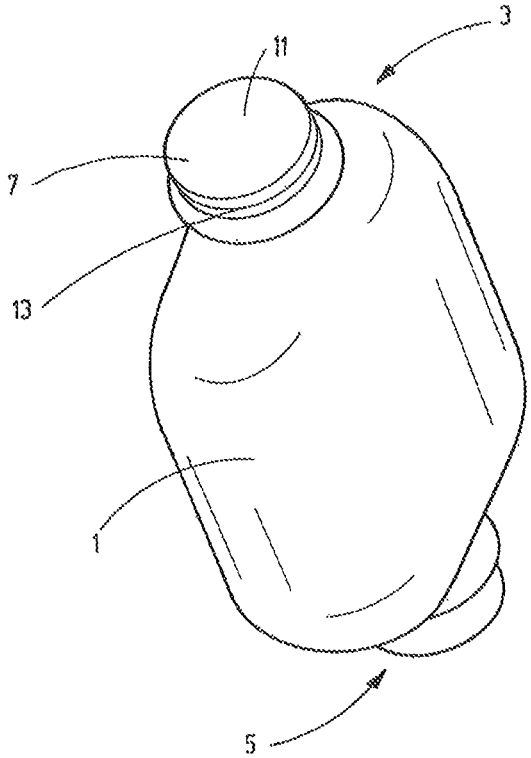
PRIOR ART Fig.2
FIG. 2 is, on a smaller scale, a perspective view of the bottle of FIG. 1.

FIGS. 1 and 2 show a container or container body produced using the mentioned blow-fill-seal (BFS) method in the form of an infusion bottle 1 with a top removal position 3 and a bottom removal position 5. The bottle 1 is produced from a plastic material such as LDPE, HDPE, PP or PET. In the case of a multiple layer embodiment, polyolefins in combination with EVOH, PET, COC, COP, PA or the like, can be provided, for example. In FIGS. 1 and 2, the bottle 1 lying at the top in the drawings has a head piece 7, which corresponds to the prior art according to DIN ISO 15759. In the case of containers with head pieces of this type, caps with an elastomer sealant (DIN ISO 15759) can be connected, e.g. by welding, injection molding or sealing, to the head piece of the filled and sealed bottle 1. On the front end of the head piece 7, a head surface 11 is provided for removal and/or feeding operations, which, in the form of a head membrane penetrable by a cannula or a spike, spans a transition region 13 at which the head piece 7 transitions into the neck part 9 of the bottle 1. The head surface 11 formed by this head membrane spans the transition region 13 with a uniformly convex curvature in the prior art.

Figure 3A:
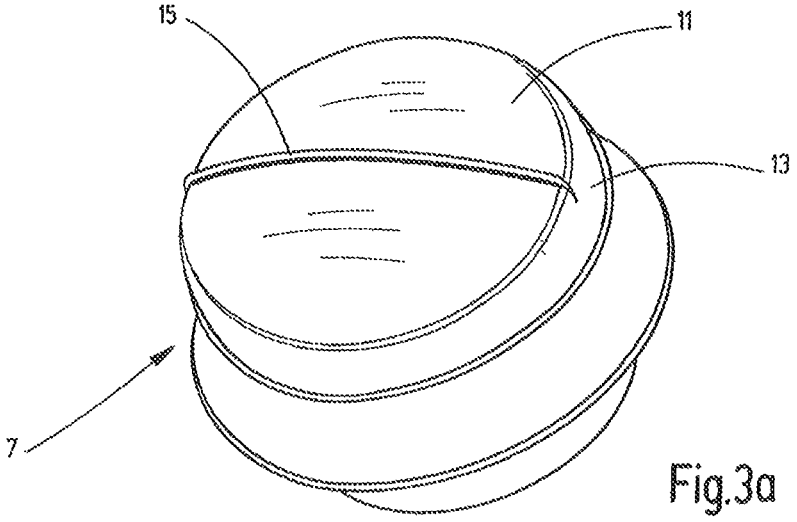
FIG. 3*a* is, at approximately twice the size compared with a practical embodiment, a perspective view of a head piece of a container according to a first exemplary embodiment of the invention.
Figure 3B:
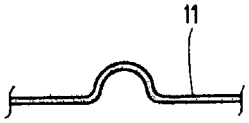
FIG. 3*b* is a partial side view in section showing a modified cross-sectional shape for the bar-shaped rib of the head piece of the exemplary embodiment of FIG. 3*a;*

FIGS. 3 to 15*a* and 17 to 19 show, to some extent in separate depictions, i.e. without depicted bottle bodies 1, different exemplary embodiments of containers according to the invention with head pieces 7, which have different types of head surfaces. FIG. 3*a* shows an example in which, in addition to a head surface 11 of the first type, which spans the transition region 13 with a convex curvature like the head surface 11 of the prior art, a head surface of the second type in the form of a reinforcing rib 15 is provided. Rib 15 forms a bar projecting significantly from the head surface 11 of the first type, spans the head surface 11 and lies diametrically therein. This bar-shaped rib 15 increases the resistance to the bending of the curvature of the head surface 11 into the inside of the container and permits the secure abutment of the elastomer component of a cover cap (not depicted), and thus, the secure sealing of the pierced spike. FIG. 3*b* shows a modified cross-sectional shape for the reinforcing rib 15 of FIG. 3*a*, wherein the top side of the rib 15 is not flat, but convex.

Figure 4B:
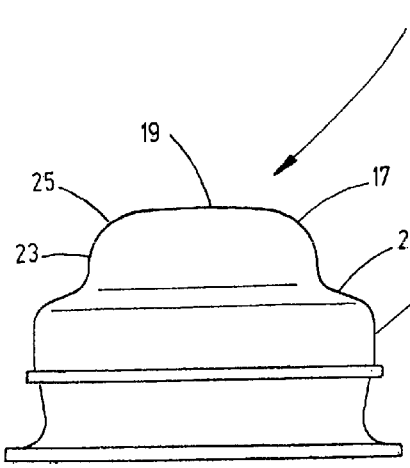
FIGS. 4*b* and 4*c* are a front view and a top view, respectively, of the head piece of a container according to a third exemplary embodiment of the invention.
Figure 4C:
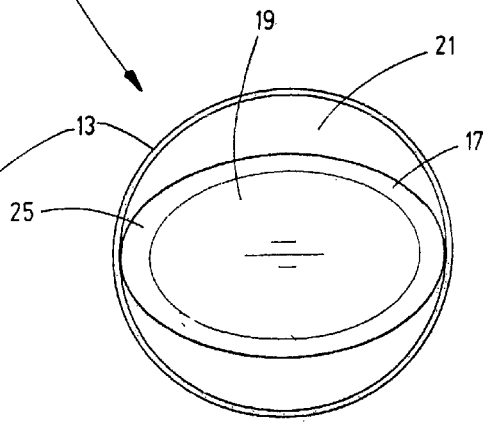
Figure 4A:
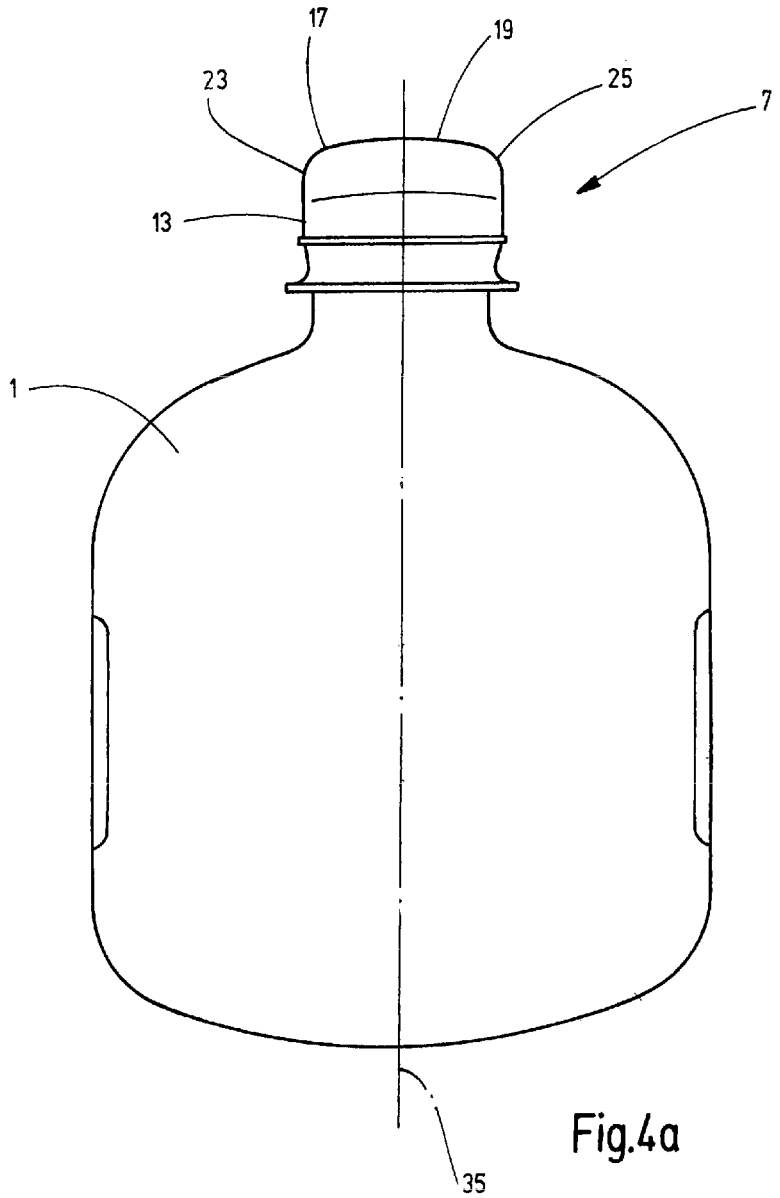
FIG. 4*a* is a front view of a container according to a second exemplary embodiment of the invention.

FIGS. 4*a* to 4*c* provide a bridge body 17 as a reinforcing or stiffening element, which, in the form of a projecting head with an oval contour, spans the free end of the transition region 13 and which, at its front top end, forms a head surface 19 of the first type with only a slightly convex curvature. Another head surface 21 connects to the foot of the bridge body 17, which other head surface is once again convex, but with greater curvature than the head surface 19. As FIG. 4*c* shows, the largest width of the bridge body 17 is somewhat more than half of the diameter of the transition region 13. Also, the height of the bridge body 17, measured relative to the surrounding head surface 21, is somewhat less than half of the largest width of the bridge body 17 as the comparison of FIGS. 4*b* and 4*c* shows. From the front head surface 19, the side wall 23 extends out from a rounding 25 surrounding the head surface 19, to the surrounding head surface 21.

Figure 5A:
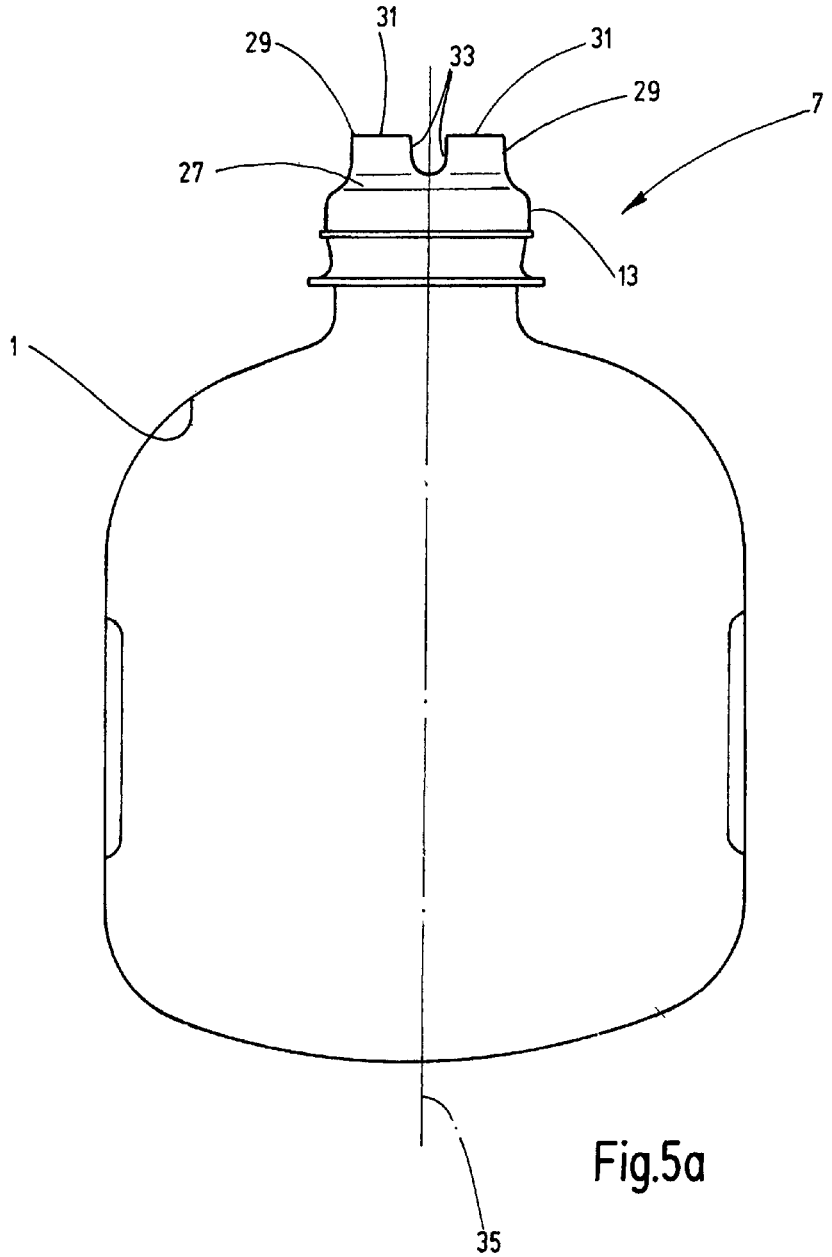
FIGS. 5*a* to 5*c* are a front view and perspective views, respectively, of head pieces according to fourth and fifth exemplary embodiments of the invention.
Figure 5B:
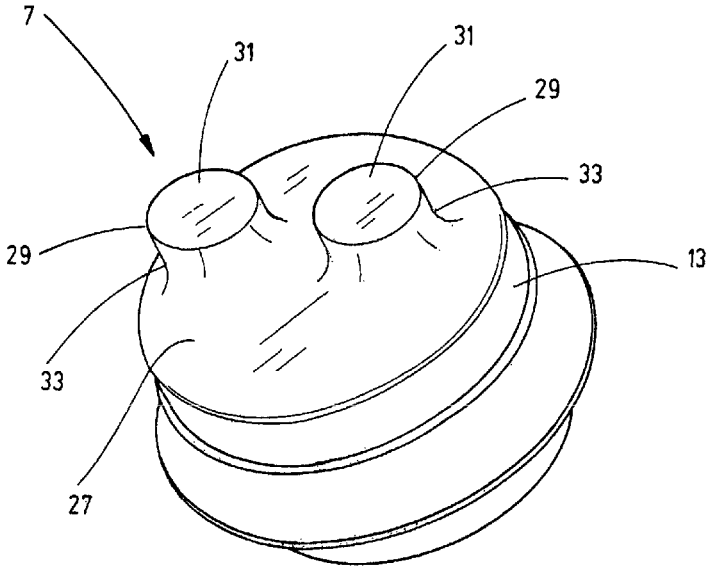
Figure 5C:
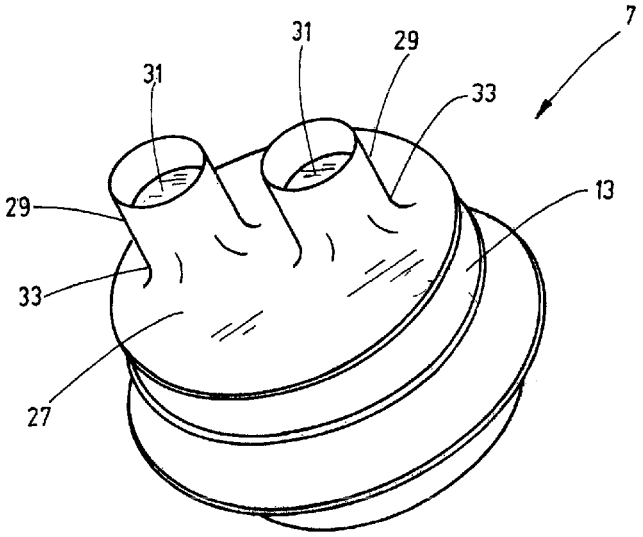

FIGS. 5*a* and 5*b* show an exemplary embodiment, in which two nipple-shaped knuckles 29 project from a head surface 27 that spans the transition region 13. The knuckles 29 lie at a distance from one another on a line extending diametrically on the head surface 27 and form, on their respective front end, a round, easily penetrable head surface 31. These head surfaces have only an extremely slight curvature, i.e. they extend almost parallel to the main plane of the head surface 27. A side wall 33 with concave curvature connects the front face surface 31 with the surrounding head surface 27. In another embodiment (not depicted), a bar-shaped rib, as in FIGS. 3*a* and 3*b*, can extend between the knuckles 29. FIG. 5*c* shows a modification compared with FIGS. 5*a* and 5*b*, wherein the head surface 31 is not provided at the top end of the knuckles 29, but is rather set back towards the inside.

Figure 6A:
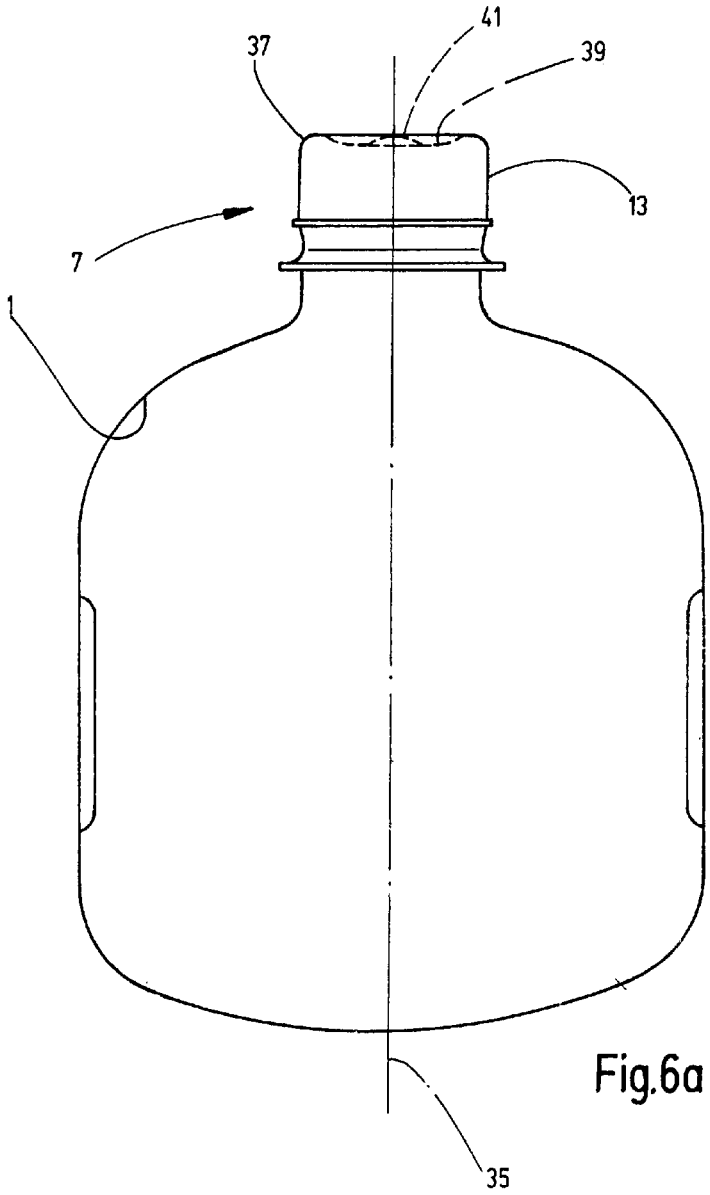
FIGS. 6*a* and 6*b* are a front view and a perspective view of a container and head piece, respectively, according to a sixth exemplary embodiment of the invention.

FIGS. 6*a* to 9*b* show other exemplary embodiments, in which all of the head surfaces are formed rotationally symmetrical and extend concentric to a longitudinal axis 35 of the transition region 13. In the example of FIGS. 6*a* and 6*b*, a convex head surface 37 is formed torus-shaped on the front edge of the circular cylindrical transition region 13. This head surface 37 surrounds concentrically a circular head surface 39 in the form of a concave depression, from which in turn another head surface 41 rises in the form of a convex dome, concentric to the axis 35. The radial width of the edge-side, outer head surface 37 is approximately ⅙ of the diameter of the transition region 13. The diameter of the dome forming the head surface 41 is approximately ⅓ of the diameter of the transition region 13. The depth of the depression forming the head surface 39 is in turn approximately 1/16 of the diameter of the transition region 13.

The head piece 7 of the exemplary embodiment of FIGS. 7*a* to 7*d* has a convex head surface 43 connecting to the front edge of the circular cylindrical transition region 13, which head surface, as part of a torus, encircles the transition region 13. This head surface 43 surrounds a knuckle 45, concentric to the axis 35, which forms a convex head surface 47 at its top side. The radial width of the outer edge-side head surface 43 corresponds to the width of the edge-side head surface 37 of the example of FIGS. 6*a* and 6*b*. The height of the knuckle 45 projecting above the edge-side head surface 43 is approximately ⅛ of the diameter of the transition region 13. In the example shown in FIGS. 7*c* and 7*d*, an additional reinforcing rib 48 is provided, which spans the head surface 47 diametrically.

Figure 8A:
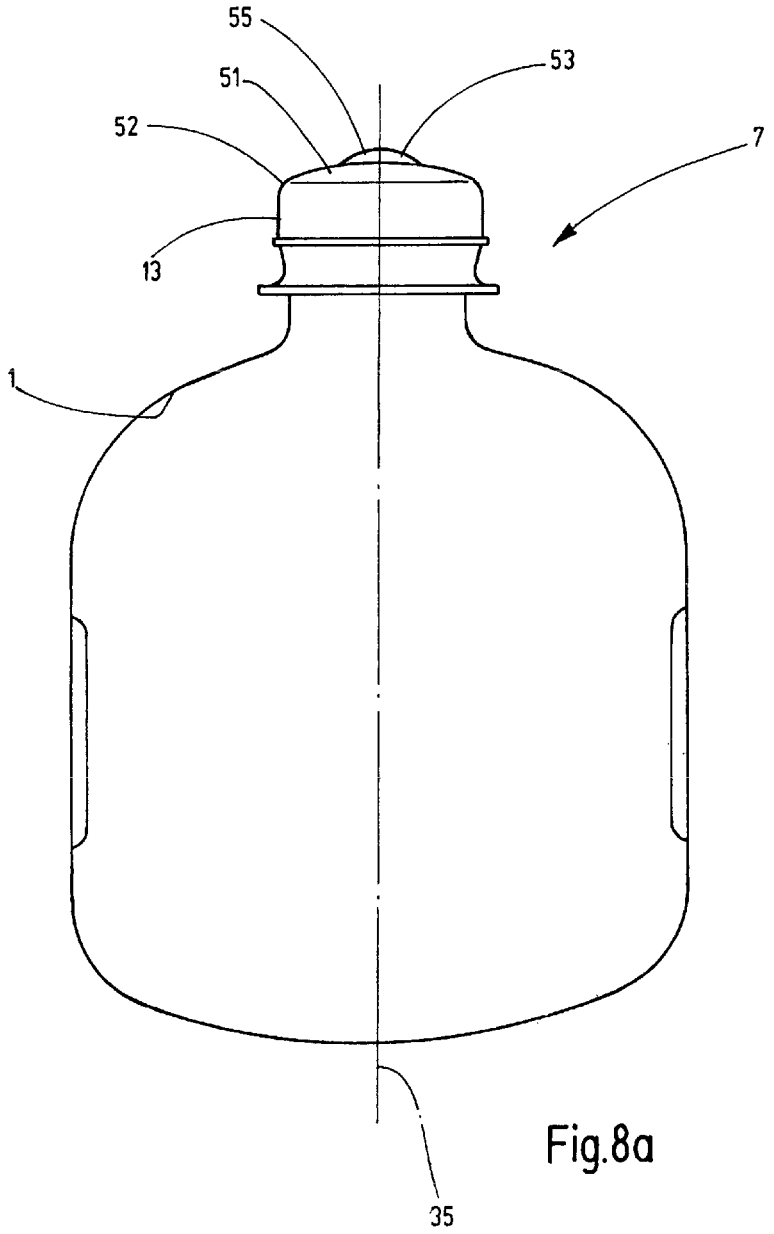
FIGS. 8*a* and 8*b* are a front view and a perspective view of a container and head piece, respectively, according to an eighth exemplary embodiment of the invention.
Figure 8B:
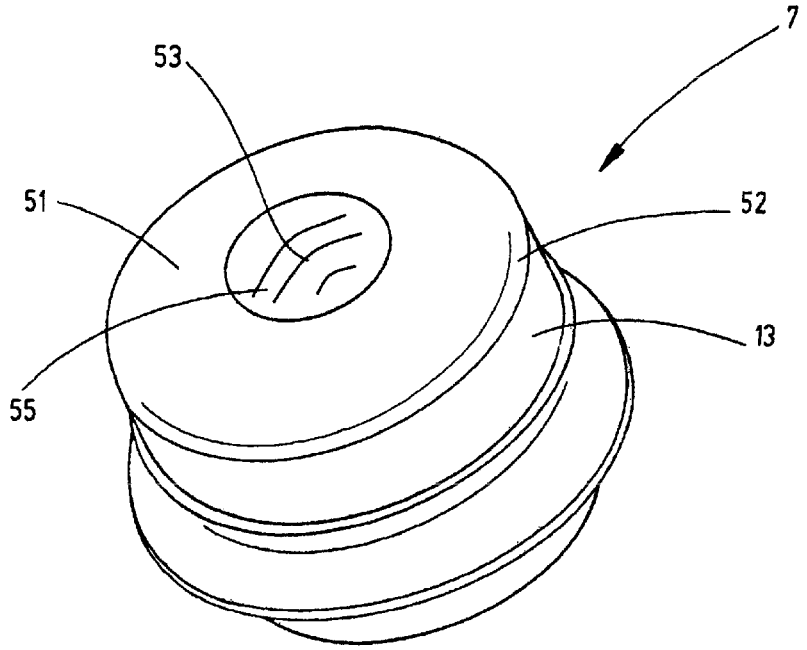

The exemplary embodiment of FIGS. 8*a* and 8*b* has a head surface 51 in the form of a convex annular surface connecting to the circumferential edge 52. A knuckle 53 rises from the central region of this annular surface concentric to the axis 35, which knuckle forms a head surface 55, which is also convex, but with greater curvature than the head surface 51. The diameter of the cylindrical transition region 13 is approximately two and a half times the diameter of the knuckle 53. The height of the knuckle 53 relative to the surrounding head surface 51 is approximately ⅙ of the diameter of the knuckle 53.

Figure 6B:
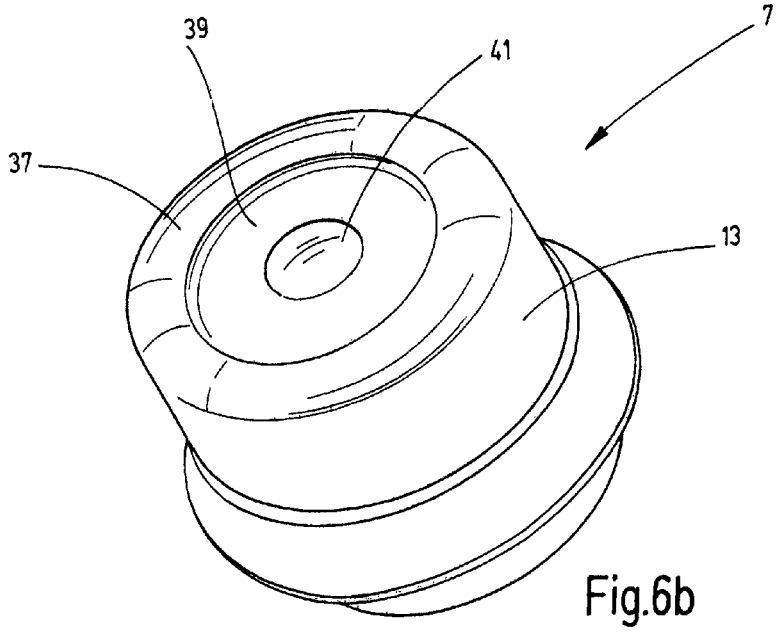
Figure 7B:
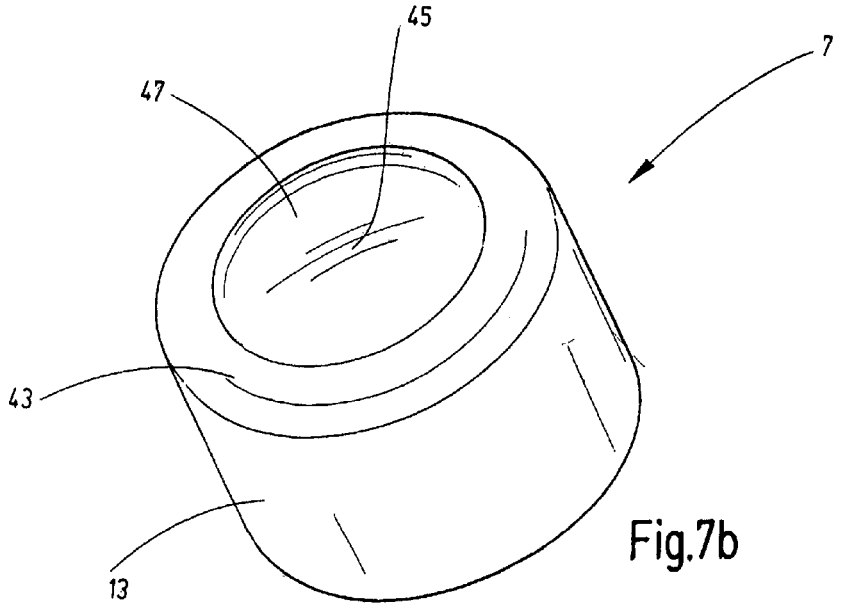
FIGS. 7*b*, 7*c*, 7*d* are perspective views (7*b*, 7*d*) and a side view (7*c*), respectively, of modified embodiments of the head piece of the exemplary embodiment of FIG. 7*a;*
Figure 7A:
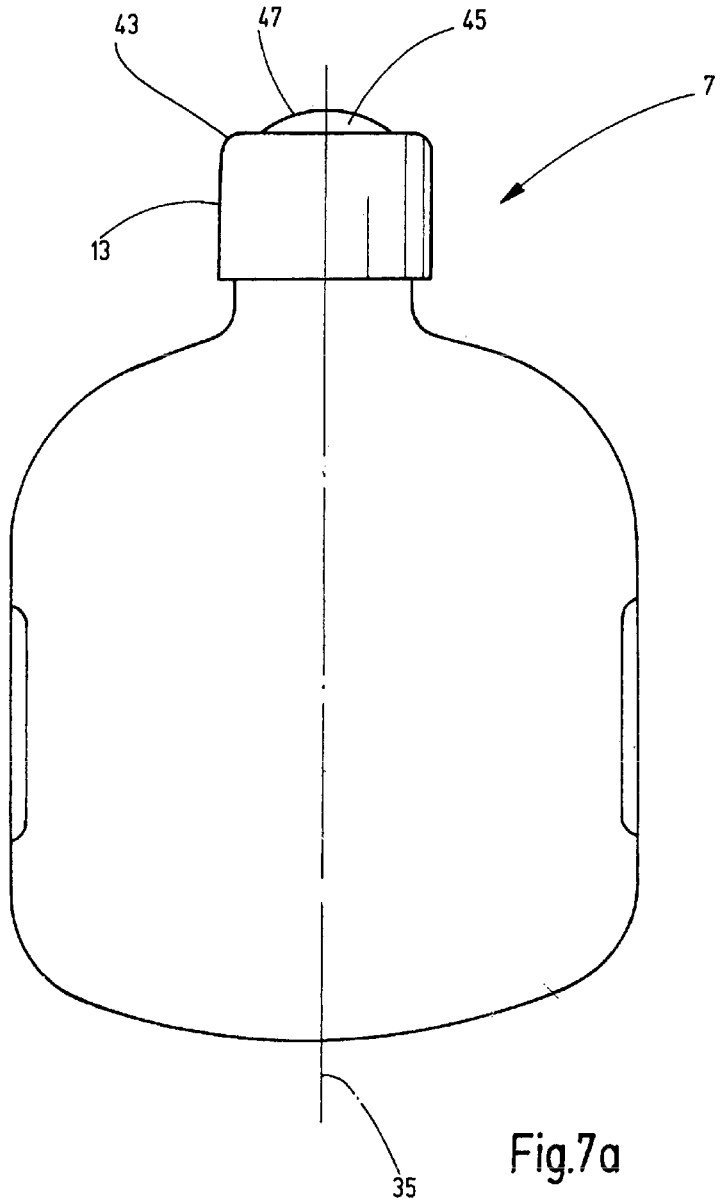
FIG. 7*a* is a front view of a container according to a seventh exemplary embodiment of the invention.
Figure 7D:
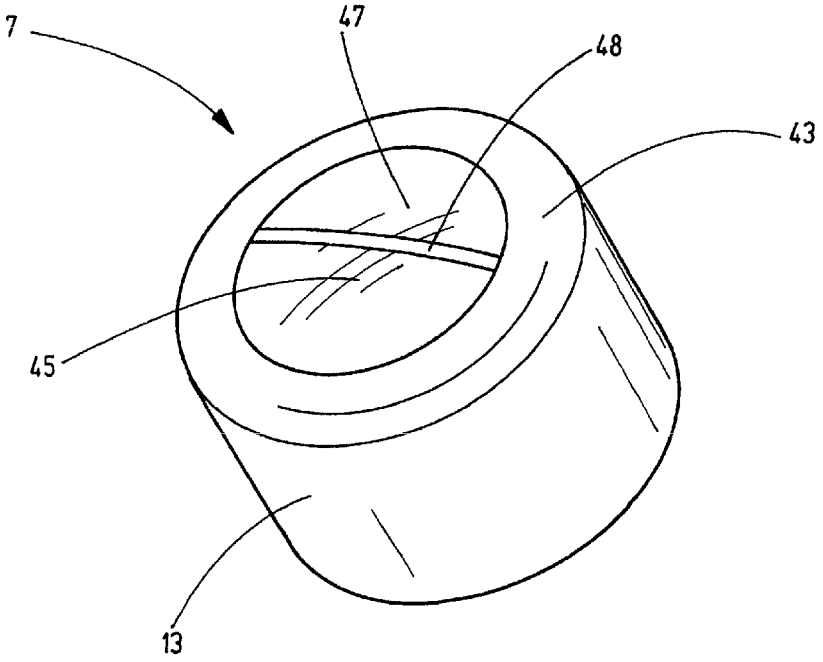
Figure 7C:
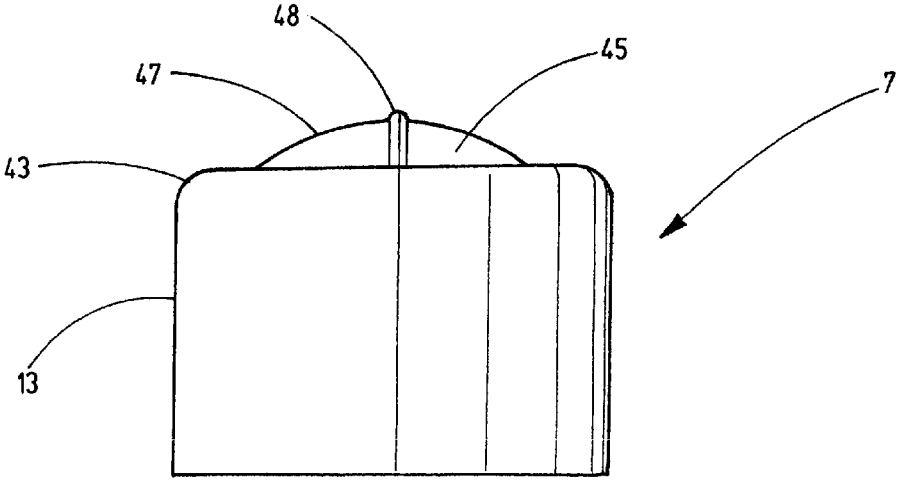
Figure 9B:
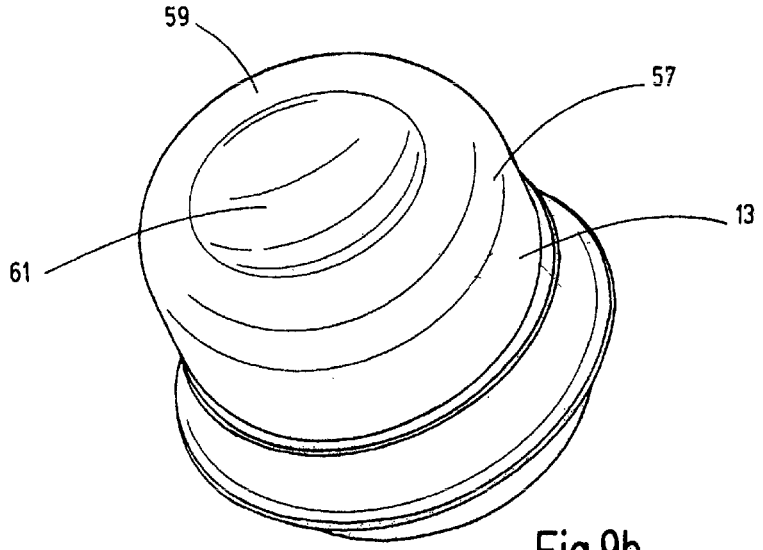
FIGS. 9*a* and 9*b* are a front view and a perspective view of a container and head piece, respectively, according to a ninth exemplary embodiment of the invention.
Figure 9A:
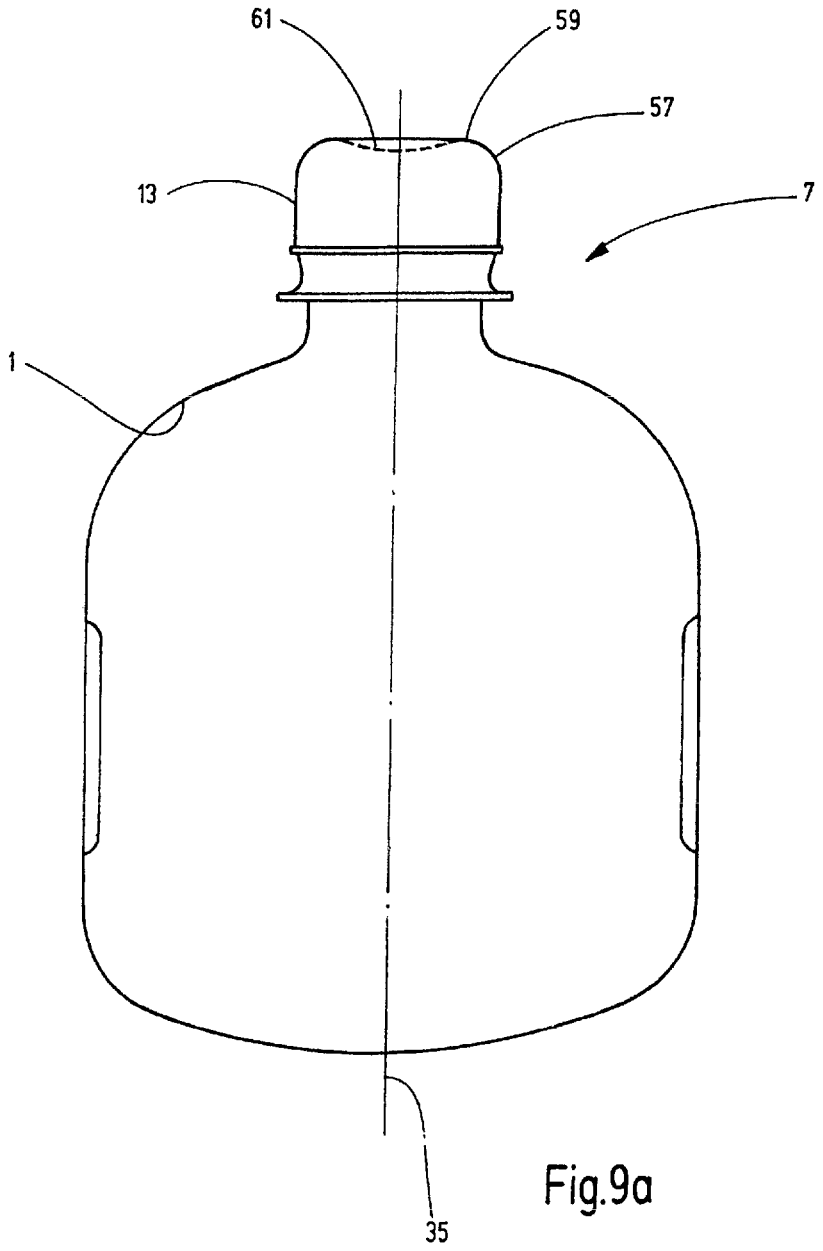

The exemplary embodiment of FIGS. 9*a* and 9*b* has, like the exemplary embodiment of FIGS. 6*a* and 6*b*, a head surface 59 with convex curvature surrounding the circumferential edge 57 of the cylindrical transition region 13. A depression-shaped recess is connected to head surface 59. The base of the recess forms a concave head surface 61. The difference compared with the example of FIGS. 6*a* and 6*b* is only that no knuckle is located in the center of the head surface 61. The width of the convex head surface 39 at the edge 57 is, in the example of FIGS. 9*a* and 9*b*, a little greater than the width of the edge-side head surface 37 in the example of FIGS. 6*a* and 6*b*. The width of the head surface 61 formed by the central depression, or pocket, is a little more than half of the diameter of the transition region 13. The axial depth of the depression forming the head surface 61 is approximately 1/10 of the diameter of the transition region 13.

Figure 10A:
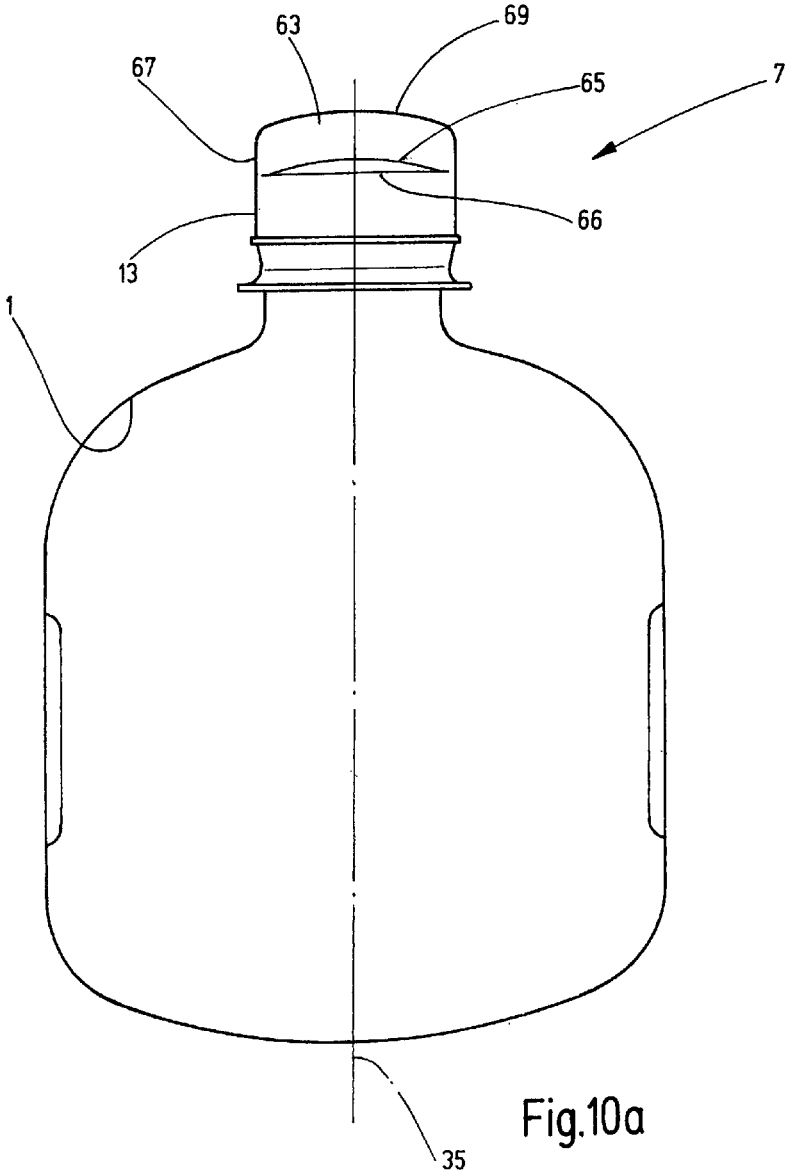
FIGS. 10*a* and 10*b* are a front view and a perspective view of a container and head piece, respectively, according a tenth exemplary embodiment of the invention.
Figure 10B:
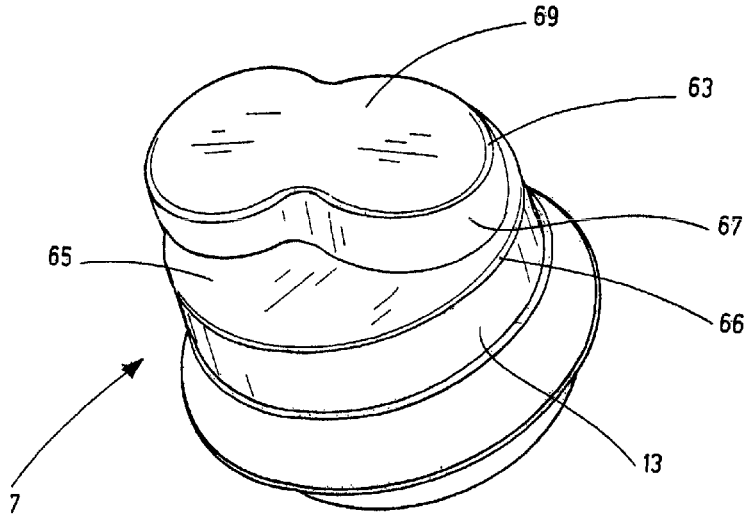

The exemplary embodiment of FIGS. 10*a* and 10*b* resembles the exemplary embodiment of FIGS. 4*a* to 4*c* to the extent that a bridge region 63 is provided. Bridge region 63 projects from a convex head surface 65, which connects to the edge 66 of the connecting region 13. By contrast with the oval bridge body 17 of FIGS. 4*a* to 4*c*, the bridge region 63 of the present example has a contour in the shape of a horizontal figure eight, with side walls 67, which descend from a front head surface 69, relatively steeply relative to the surrounding head surface 65. As FIG. 10*a* more clearly shows, the head surface 69 has a convex curvature. The height of the bridge body 63 relative to the surrounding head surface 65 is approximately ¼ of the diameter of the circular cylindrical transition region 13. The largest width of the bridge region 63 at the arms of the figure eight forming the contour is somewhat less than half of the diameter of the transition region 13.

Figure 11A:
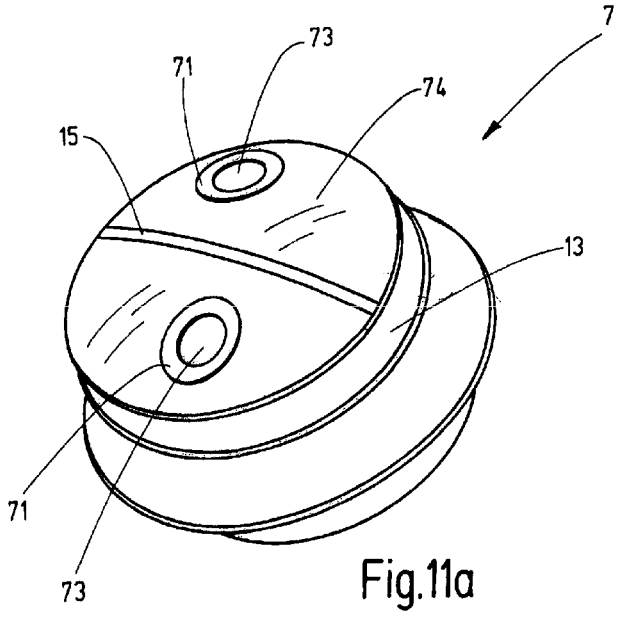
FIG. 11*a* is a perspective view of the head piece of FIG. 11, with an additional reinforcing rib.
Figure 11:
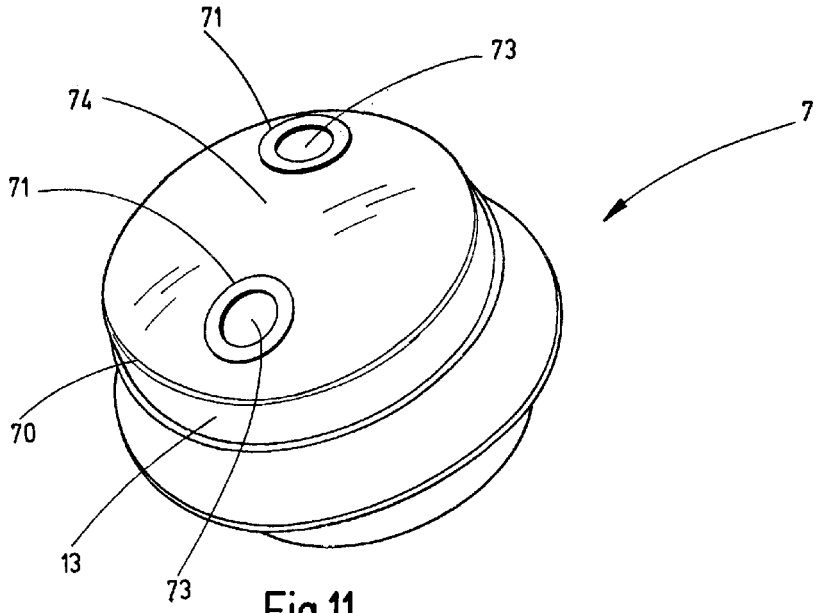
FIG. 11 is a perspective oblique view of a head piece according to an eleventh exemplary embodiment of the invention.

FIG. 11 shows an exemplary embodiment which, similarly to the head surface 11 in the exemplary embodiment of FIG. 3, has a convex head surface 74, which connects to the edge 70 of the transition region 13 over the entire circumference thereof. Arranged on this head surface 74 are two annular bodies 71 in the form of flat circular rings, which are arranged at a spacing from one another along a line extending diametrically over the head surface 74. The external diameter of these flat rings is approximately ⅙ of the diameter of the transition region 13. The annular bodies 71 are arranged such that the spacing between them is greater than the spacing of each annular body 71 from the circumferential edge 70 of the transition region 13. At their top side, the annular bodies 71 each form a head surface 73 in the form of a slightly convex circular surface.

In addition, as is also the case in the exemplary embodiments of FIGS. 3*a* and 3*b*, a bar-type reinforcing rib 15 can be provided, extending diametrically over the head surface 74, as depicted in FIG. 11*a*.

Figure 12:
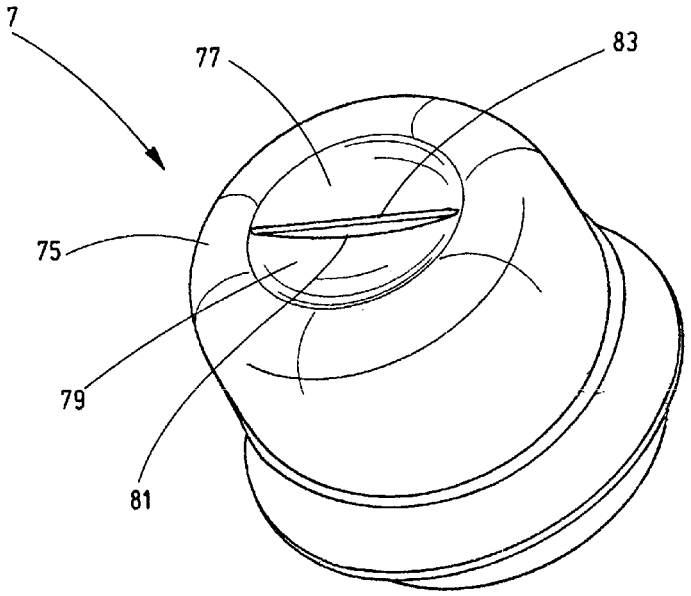
FIGS. 12 and 13 are perspective views of head pieces according to twelfth and thirteenth exemplary embodiments of the invention.

The exemplary embodiment of FIG. 12 resembles the exemplary embodiment of FIGS. 9*a* and 9*b*. In other words, it has a depression 77 delimited by the edge-side, convex head surface 75, which depression 77 forms a concave head surface 79. Mounted on the base of the depression 77, a diametrically extending stiffening rib 81 extends in the form of a straight bar with axially parallel side walls and a slightly convex top side, which abuts the edge-side head surface 75 as another head surface 83.

Figure 13:
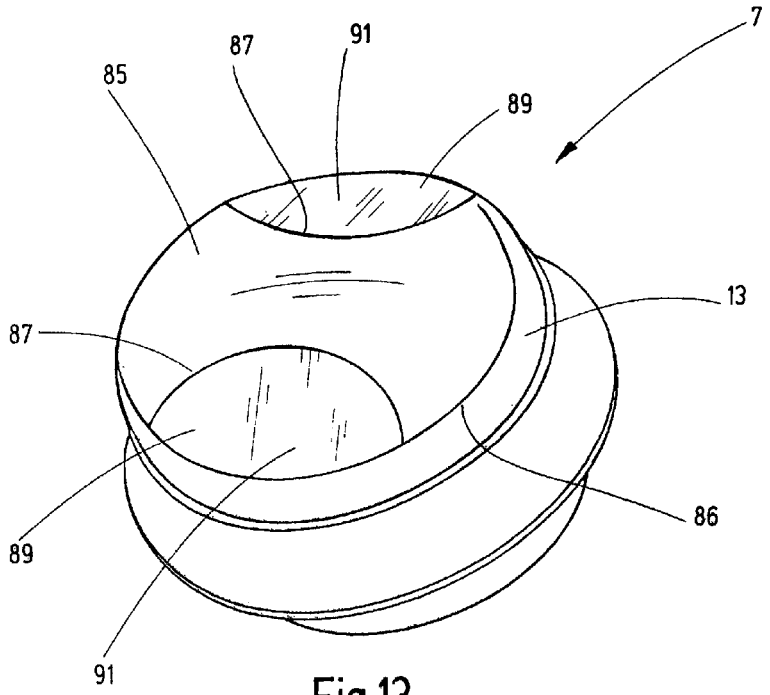
Figure 13A:
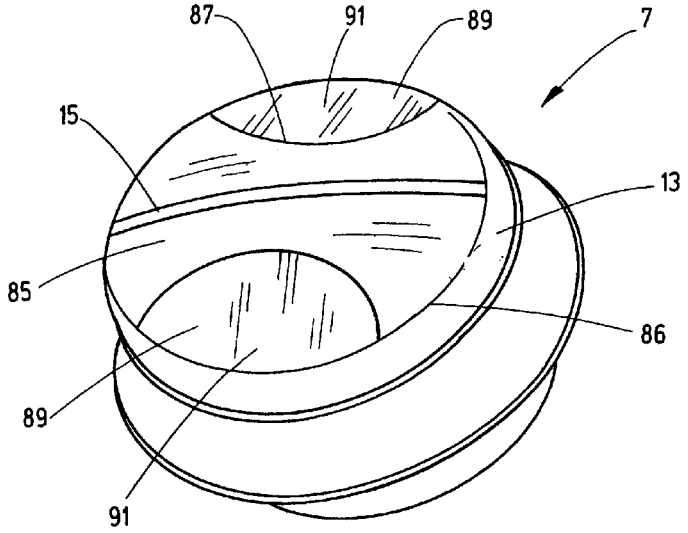
FIG. 13*a* is a perspective view of the head piece of FIG. 13, with an additional reinforcing rib.

FIG. 13 shows an exemplary embodiment, in which a convex head surface 85 continuously spans the transition region 13 between its circumferential edge 86. In a symmetrical arrangement, chamfers 89 lying diametrically opposite one another connect at arc-shaped connecting lines, which chamfers each form another, slightly convex head surface 91. As FIG. 13*a* shows, in a modification of the example of FIG. 13 too, an additional bar-type reinforcing rib 15 can be provided, which rib spans the head surface 85.

Figure 14:
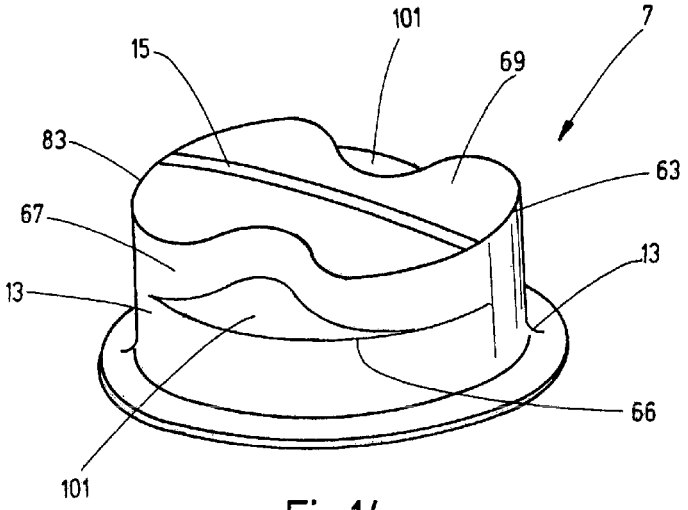
FIG. 14 is a perspective view of a modified embodiment of the head piece of FIGS. 10*a* and 10*b;*

The exemplary embodiment of FIG. 14 resembles the exemplary embodiment of FIGS. 10*a* and 10*b*, wherein side penetration surfaces 101, defined by the contour shape of the bridge body 63, are formed. In this configuration, the penetration surfaces 101 have a maximum spacing from one another. This is advantageous when both locations are used for piercing and the corresponding spike or the drip chamber remains therein. A reinforcing rib 15 is additionally provided in the example of FIG. 14 to ensure a high level of bending resistance. This reinforcing rib can also have a rounded shape, as depicted in FIG. 3*b*.

Figure 15B:
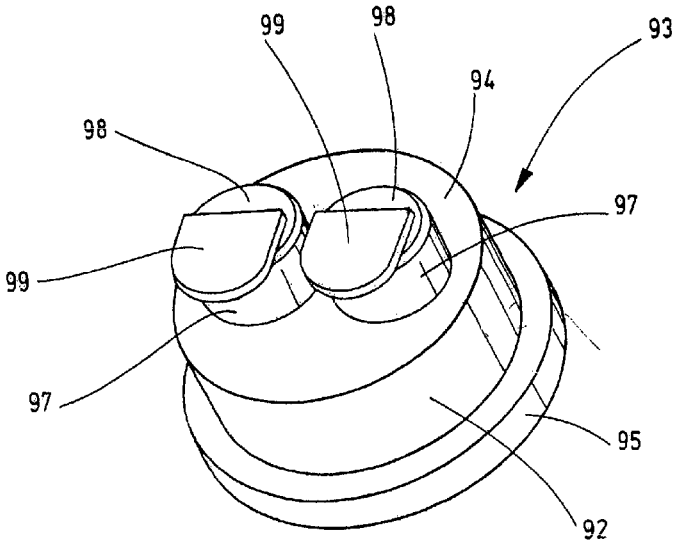
FIG. 15*b* is a perspective view of a cover cap for the head piece of the exemplary embodiment of FIG. 5*a;*
Figure 15A:
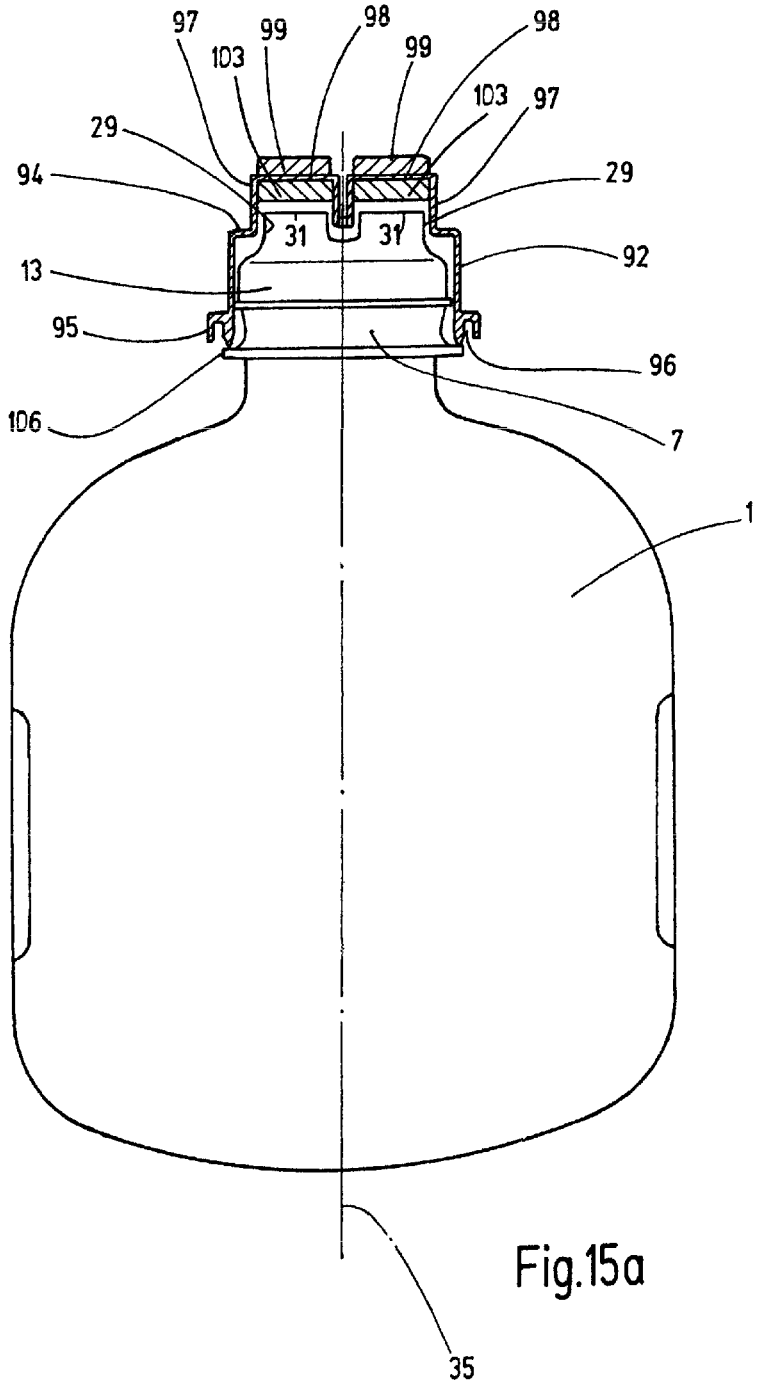
FIG. 15*a* is a front view of a container according to a fourteenth exemplary embodiment of the invention, with a cross-sectional depiction of a cover cap of the head piece in the state prior to a welding operation.
Figure 15C:
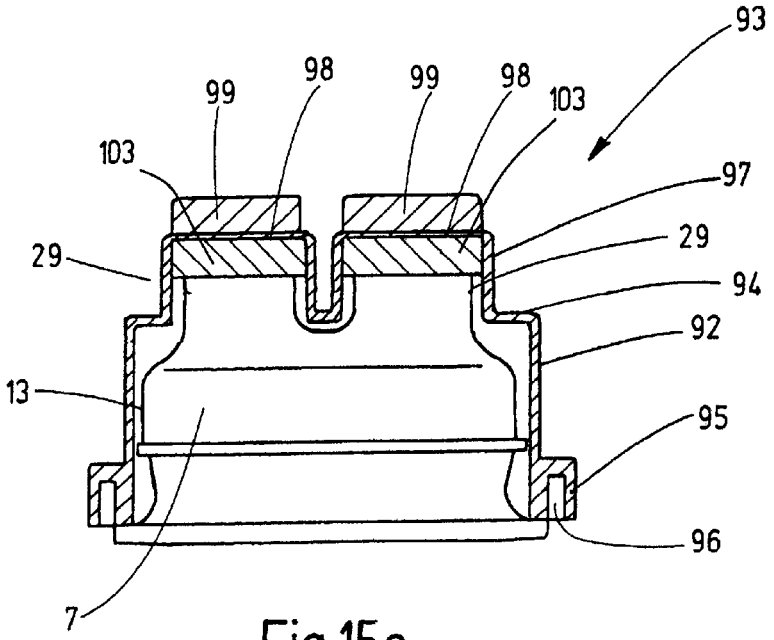
FIG. 15*c* is a front view section of a head piece with a welded on cap according to FIG. 15*b*, after the welding operation.
Figure 16B:
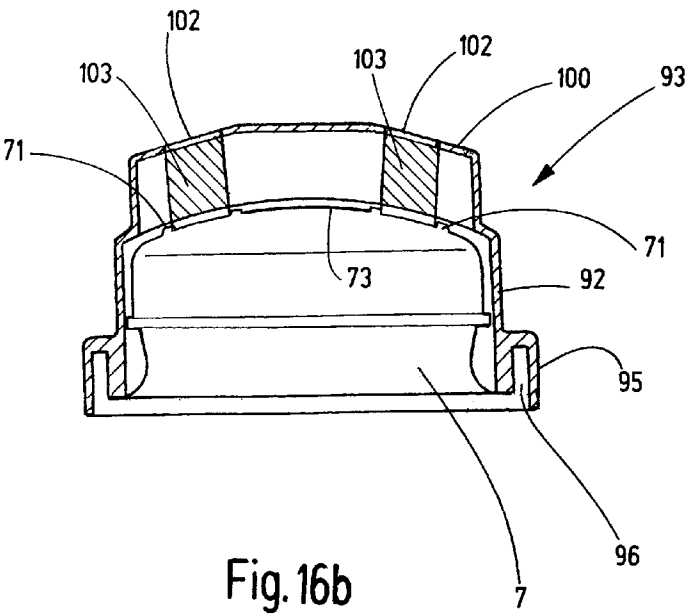
FIG. 16*b* is a front view in section of the cap according to FIG. 16*a* on a head piece according to the exemplary embodiment of FIG. 11.
Figure 16A:
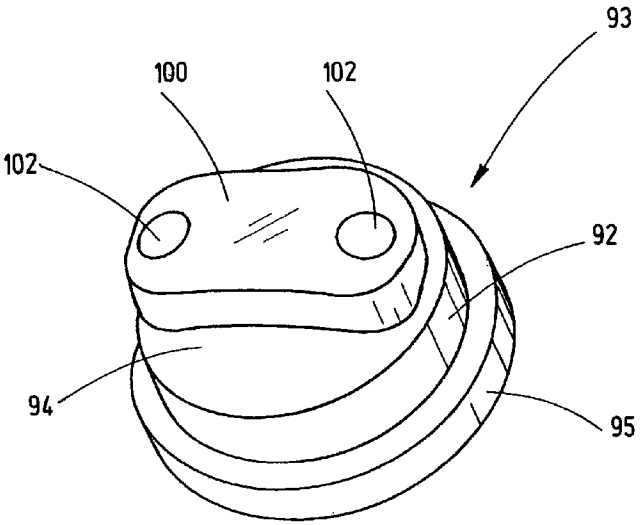
FIG. 16*a* is a perspective view of a modified embodiment of a cover cap for a container according to the invention, according to the exemplary embodiment of FIG. 11.

FIGS. 15*a* to 16*b* also show by way of an example cover caps 93, with the design shown in FIGS. 15*a* and 15*b* being provided for head pieces according to the examples of FIGS. 5*a* to 5*c* and the design of FIGS. 16*a* to 16*c* being provided for a head piece 7 according to the exemplary embodiment of FIG. 11, for example. The cover cap 93 of FIGS. 15*a* to 15*c* is a hollow body made of a plastic, for example, the same material from which the bottle is made. The cover cap 93 has a hollow cylindrical main part 92, which spans the transition region 13 of the head piece 7 and has, at the open end, an edge 95 forming a radial extension, in which a circumferential annular groove 96 is located. In the case of a cover cap 93 fixed onto the head piece 7 by welding, injection molding, adhesion or sealing, the edge 95 can form a connecting part for an adapter. FIG. 15*a* shows a state prior to welding. As can be seen, a lug 106 is formed on the end edge of the main part 92, which lug forms an energy guide for welding processes, such as ultrasonic welding. This lug 106 is welded so that, once a welding operation has been carried out, the state depicted in FIG. 15*c* is obtained. Sleeve bodies 97 are molded onto the top side 94, which sleeve bodies are aligned in such a way that they are flush with the knuckles 29 on the head piece 7. In the initial state, which is depicted in the figures, the sleeve bodies 97 are closed by a disk 98 that can be torn off at predetermined breaking points. A tab 99 is installed that permits easy tearing off of the disks 98 so as to clear the way for access to the elastomer 103 bearing against the penetrable head surface 31 of the head piece 7.

The example of FIGS. 16*a* and 16*b* differs from the FIG. 15*a-c* embodiment in that, instead of the projecting sleeve bodies 97 on the top side 94, a dome-shaped hollow box construction 100 is provided. In box construction 100, two openings 102 are arranged in such a way that they are aligned with the region of the annular bodies 71 of FIG. 11, which are located on the head surface 74 of the head piece 7. For use operations, the part of the head surface 74 surrounded by the annular body 71 can therefore be penetrated via the openings 102. As depicted, an elastomer 103 is provided above the penetration surface delimited by the annular bodies 71, for the formation of a seal on the penetration surfaces.

Figure 17:
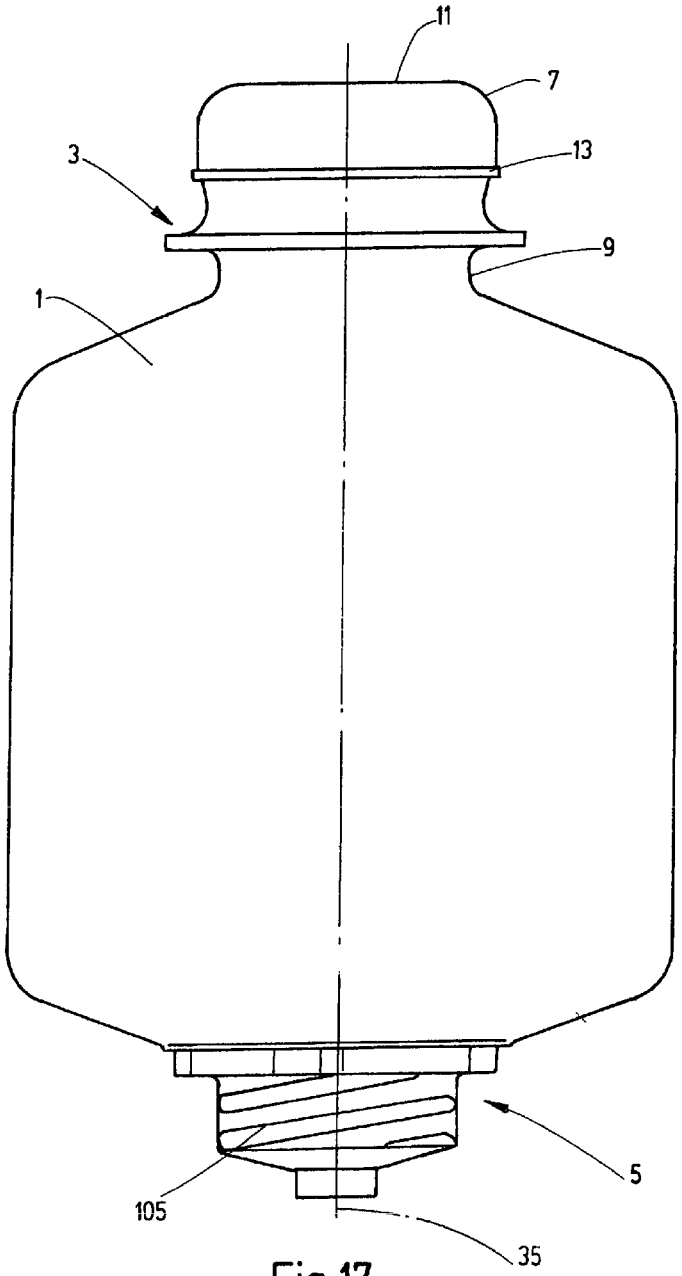
FIG. 17 is a front view of a container according to a fifteenth exemplary embodiment of the invention in the form of an infusion bottle with two removal openings, one of which is provided with a screw connection.

FIG. 17 shows, in a depiction corresponding to FIG. 1, an embodiment of the bottle 1 which has two removal positions 3 and 5 lying opposite one another. The access lying at the bottom in the figure is provided with an external thread 105. A head piece 7 according to the exemplary embodiment of FIG. 1 is located at the top removal position.

Figure 18:
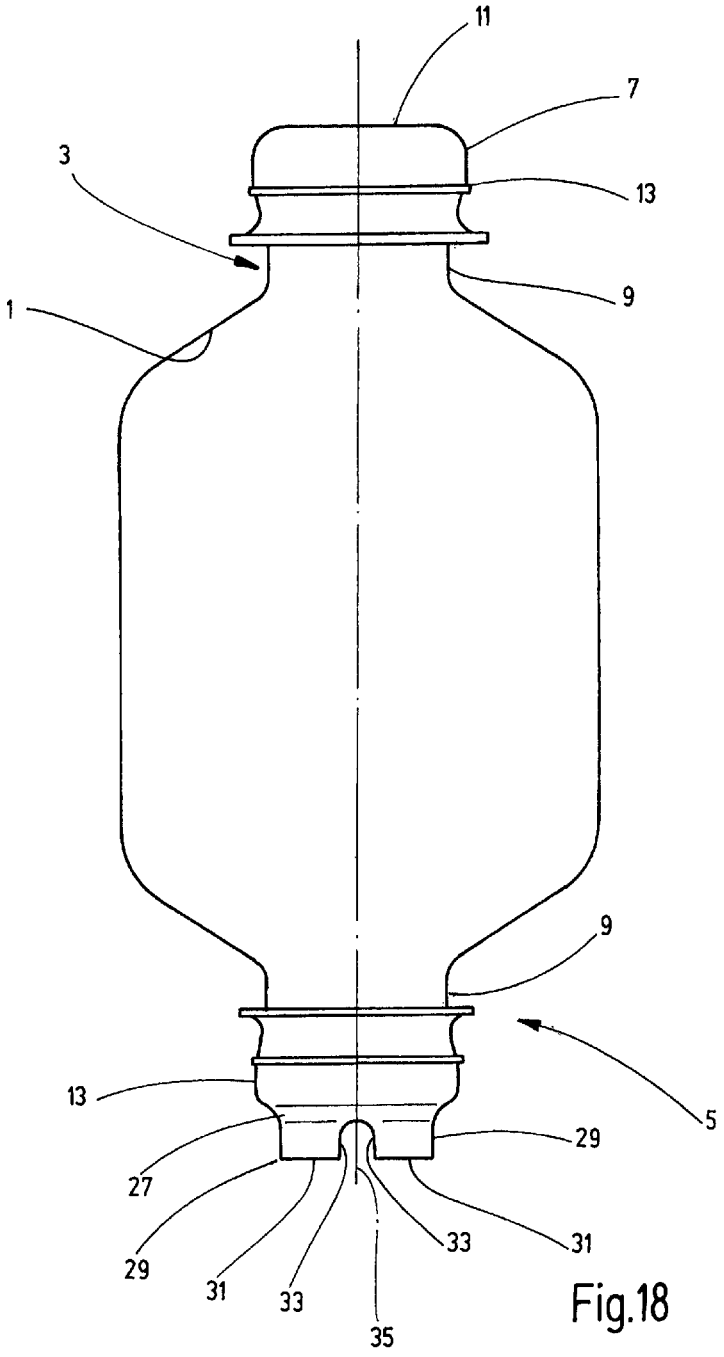
FIG. 18 is a front view of a container according to an exemplary embodiment of the invention, with a head piece according to FIG. 5*a* provided on a removal opening.

FIG. 18 shows a bottle 1 corresponding to FIG. 17 with a head piece 7 according to the example of FIG. 5*b* located at the bottom removal position 5.

Figure 19:
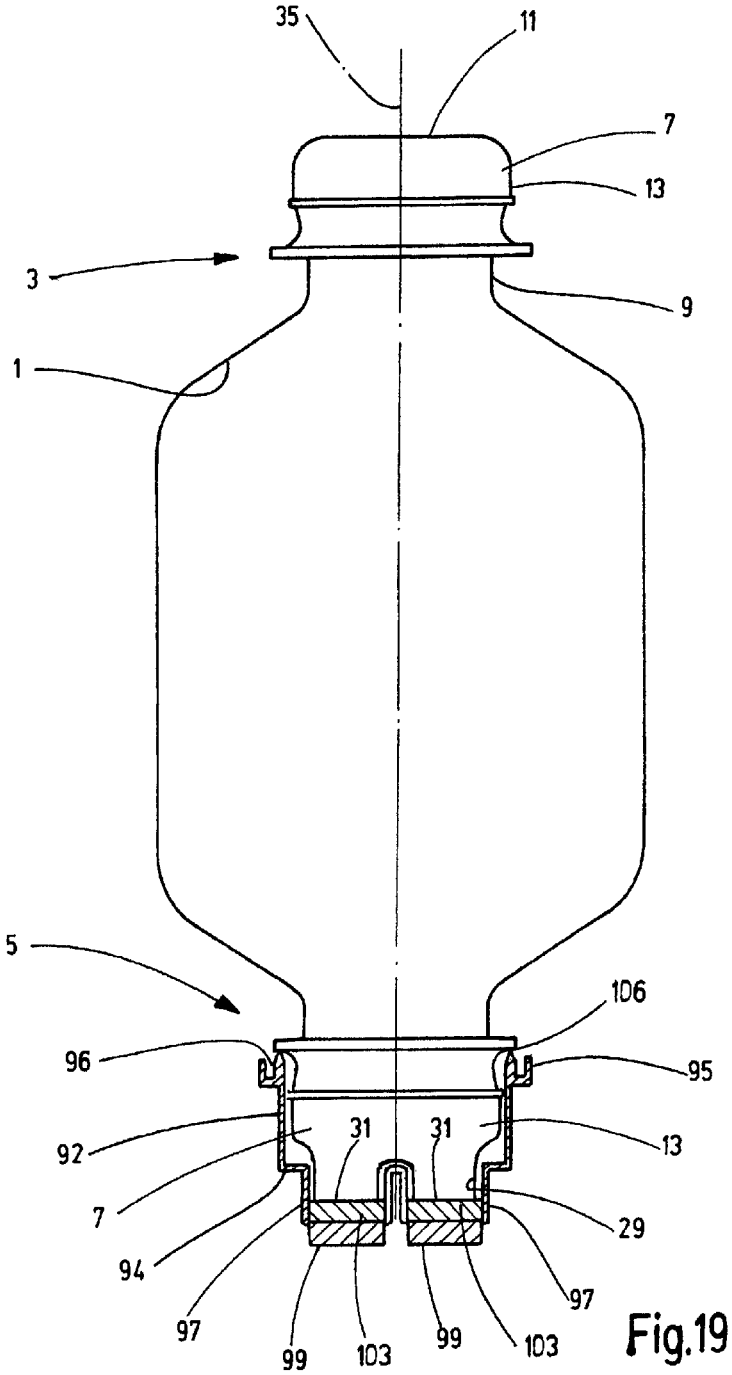
FIG. 19 is a front view, partially in section, of the infusion bottle of FIG. 18, wherein the head piece lying at the bottom is provided with an end cap according to FIG. 15*b*, prior to the welding operation.

FIG. 19 shows the bottle 1 of FIG. 18, wherein the head piece 7 at the bottom removal position 5 is provided with a cap 93 according to the example of FIG. 15*b*.

All solutions according to the invention described above have in common that the container 1 is produced using the blow molding, filling, and sealing method and is formed in one piece with its special head piece 7 according to the invention. Amongst other things, the container wall transitions continuously into the wall of the head piece 7.

While various embodiments have been chosen to illustrate the invention, it will be understood by those skilled in the art that various changes and modifications can be made therein without departing from the scope of the invention as defined in the claims.

The invention claimed is:

1. A container filled with a medium and producible from plastic materials using a blow molding-filling-sealing method, the container comprising:

a container body having a longitudinal axis;

a head piece;

a transition region connecting said head piece to said container body as integral components;

a first head surface being on said head piece at a front end thereof, being penetrable by a piercing or cutting part and extending with a specifiable first curvature;

a second head surface being on said head piece and extending with a specifiable second curvature different from said first curvature, said first and second head surfaces transitioning into each other forming an overall head surface spanning a free end of said transition region directed away from said container body, being rotationally symmetrical relative to said longitudinal axis and extending concentric relative to said longitudinal axis, one of said first and second head surfaces being convex relative to said head piece and extending axially along said longitudinal axis in a direction away from said container body and another of said first and second head surfaces being concave relative said head piece and opening axially along said longitudinal axis in the direction away from said container body; and a third head surface being on said head piece and extending with a specifiable third curvature different from said first and second curvatures, said third head surface surrounding said first and second head surfaces.

2. A container according to claim 1 wherein said first and second head surfaces transitions directly or via connecting region into each other forming said overall head surface.

3. A container according to claim 1 wherein at least one of said first and second head surfaces extend transverse to longitudinal axis.

4. A container filled with a medium and producible from plastic materials using a blow molding-filling-sealing method, the container comprising:

a container body having a longitudinal axis;

a head piece;

a transition region connecting said head piece to said container body as integral components;

a first head surface being on said head piece at a front end thereof, being penetrable by a piercing or cutting part and extending with a specifiable first curvature; and a second head surface being on said head piece and extending with a specifiable second curvature different from said first curvature, said first and second head surfaces transitioning into each other forming an overall head surface spanning a free end of said transition region directed away from said container body, being rotationally symmetrical relative to said longitudinal axis and extending concentric relative to said longitudinal axis, one of said first and second head surfaces being convex and another of said first and second head surfaces being concave relative said head piece; and a third head piece surface being on said head piece and extending with a third curvature different from said first and second curvatures, said third head piece surface having a bar-shaped stiffening rib.

5. A container filled with a medium and producible from plastic materials using a blow molding-filling-sealing method, the container comprising:

a container body having a longitudinal axis;

a head piece;

a transition region connecting said head piece to said container body as integral components;

a first head surface being on said head piece at a front end thereof, being penetrable by a piercing or cutting part and extending with a specifiable first curvature;

a second head surface being on said head piece and extending with a specifiable second curvature different from said first curvature, said first and second head surfaces transitioning into each other forming an overall head surface spanning a free end of said transition region directed away from said container body, being rotationally symmetrical relative to said longitudinal axis and extending concentric relative to said longitudinal axis, one of said first and second head surfaces being convex and another of said first and second head surfaces being concave relative said head piece; and a cap with an elastomer sealing element connected to said head piece, said elastomer sealing element being essentially only located opposite a penetration surface of said head piece and being connected to said penetration surface with a small spacing.

6. A container according to claim 5 wherein said cap comprises an energy guide for welding said cap to said head piece by ultrasonic welding, friction welding or vibration welding.

7. A container according to claim 5 wherein said elastomer sealing element has an opening for a spike.

8. A container according to claim 7 wherein said opening is cylindrical.

9. A container according to claim 7 wherein said opening is annular.

10. A container according to claim 1 wherein each of said first and second head surfaces as an annular periphery surrounding said longitudinal axis.

11. A container filled with a medium and producible from plastic materials using a blow molding-filling-sealing method, the container comprising:

a container body having a longitudinal axis;

a head piece;

a transition region connecting said head piece to said container body as integral components;

a first head surface being on said head piece at a front end thereof, being penetrable by a piercing or cutting part and extending with a specifiable first curvature;

a second head surface being on said head piece and extending with a specifiable second curvature different from said first curvature, said first and second head surfaces transitioning into each other forming an overall head surface spanning a free end of said transition region directed away from said container body, being rotationally symmetrical relative to said longitudinal axis and extending concentric relative to said longitudinal axis, one of said first and second head surfaces being convex relative to said head piece and extending axially along said longitudinal axis in a direction away from said container body and another of said first and second head surfaces being concave relative said head piece and opening axially along said longitudinal axis in the direction away from said container body, said first head surface surrounding said second head surface; and a third head surface being on said headpiece and extending with a specifiable third curvature different from said first and second curvatures, said third head surface being entirely laterally spaced from said longitudinal axis.

12. A container according to claim 11 wherein said first head surface is concave; and said second head surface is convex.

13. A container according to claim 11 wherein said first head surface is convex; and said second head surface is concave.

14. A container body according to claim 1 wherein said third head surface is entirely laterally spaced from said longitudinal axis.

15. A container body according to claim 1 wherein said third head surface does not extend axially along said longitudinal axis in the direction away from said container beyond said one of said first and second head surfaces being convex.

16. A container body according to claim 11 wherein said third head surface surrounds said first and second head surfaces.

17. A container body according to claim 11 wherein said third head surface does not extend axially along said longitudinal axis in the direction away from said container beyond said one of said first and second head surfaces being convex.

* * * * *